United States Patent [19]

Post

[11] 4,095,528

[45] Jun. 20, 1978

[54] VEHICLE WITH COMBINED FUEL TANK/WARHEAD

[75] Inventor: Donald McChesney Post, San Diego, Calif.

[73] Assignee: Teledyne Ryan Aeronautical Division of Teledyne Industries, Inc., San Diego, Calif.

[21] Appl. No.: 763,318

[22] Filed: Jan. 28, 1977

[51] Int. Cl.[2] ..... F42B 13/28

[52] U.S. Cl. ..... 102/49.8; 102/56 R; 102/57; 102/DIG. 9

[58] Field of Search ..... 102/49.5, 49.8, 56 R, 102/67, DIG. 9, 57

[56] References Cited

U.S. PATENT DOCUMENTS

| | | | |
|---|---|---|---|
| 2,884,859 | 5/1959 | Alexander et al. | 102/38 |
| 3,072,829 | 1/1963 | McDonal | 340/125 D |
| 3,572,249 | 3/1971 | Davis | 102/67 |
| 3,724,379 | 4/1973 | Davis | 102/67 |
| 3,995,549 | 12/1976 | Mullen, Jr. | 102/56 SC |

*Primary Examiner*—Verlin R. Pendegrass
*Attorney, Agent, or Firm*—Brown & Martin

[57] ABSTRACT

A vehicle driven by a combustible fuel propulsion system, in which the fuel remaining upon arrival at the target is exploded to act as a warhead. The vehicle has a fuel tank incorporated into the structure, which will hold more than enough fuel to complete the mission. The residual fuel is atomized into the vacant space in the fuel tank and mixed with air or oxygen, which can be used as the driving agent for the atomization. The fuel/air mixture is then detonated. The fuel tank may be thin walled for maximum blast effect, or be of heavier structure which is grooved for fragmentation.

2 Claims, 4 Drawing Figures

VEHICLE WITH COMBINED FUEL TANK/WARHEAD

BACKGROUND OF THE INVENTION

Guided missiles and the like usually have a warhead distinct from the other components of the vehicle, and contained in or comprising a portion of the missile body. One type of warhead utilizes a fuel/air explosive (FAE) technique, in which a highly combustible liquid or gas is ejected in a cloud over the target. The cloud is usually in the form of vapor, droplets, or a mixture and mixes with the ambient air or with an oxygen supply ejected with the fuel. After a brief delay for the cloud to spread the fuel/air mixture is detonated, resulting in a large area explosion which is particularly disruptive. The technique has also been used in bombs and artillery shells.

In a missile, the fuel/air warhead is still a separate section requiring its own structure.

SUMMARY OF THE INVENTION

The vehicle described herein has a fuel tank for the propulsion fuel supply, which also serves as a warhead using the fuel remaining in the tank when the missile arrives at the target. This eliminates the need for a separate structural section for the warhead and makes use of fuel which would otherwise be ejected or burn in an ineffective manner when the warhead explodes.

The fuel tank contains an atomizer with a pick up tube extending into the fuel supply, the atomizer opening into the main cavity of the tank well above the fuel level to be expected at the end of a flight. A source of compressed air oxygen drives the atomizer and provides the necessary fuel/air mixture inside the tank. A timed detonator then explodes the mixture and bursts the tank structure in the manner of a warhead.

For maximum blast and fire effect the fuel tank may be of thin wall construction. If fragmentation is required, the fuel tank wall may be of heavier construction, suitably grooved or otherwise weakened in a specific pattern to break up into effective fragments.

The primary object of this invention, therefore, is to provide a new and improved vehicle with a combined fuel tank and warhead.

Another object of this invention is to provide a combustible fuel propelled vehicle in which the residual fuel is used as the explosive medium.

A further object of this invention is to provide a vehicle containing means for producing a cloud of fuel and oxygen mixture inside the fuel tank and detonating the mixture.

Other objects and advantages will be apparent in the following detailed description, taken in conjunction with the accompanying drawing, in which.

DESCRIPTION OF THE PREFERRED EMBODIMENT

Figure 1:
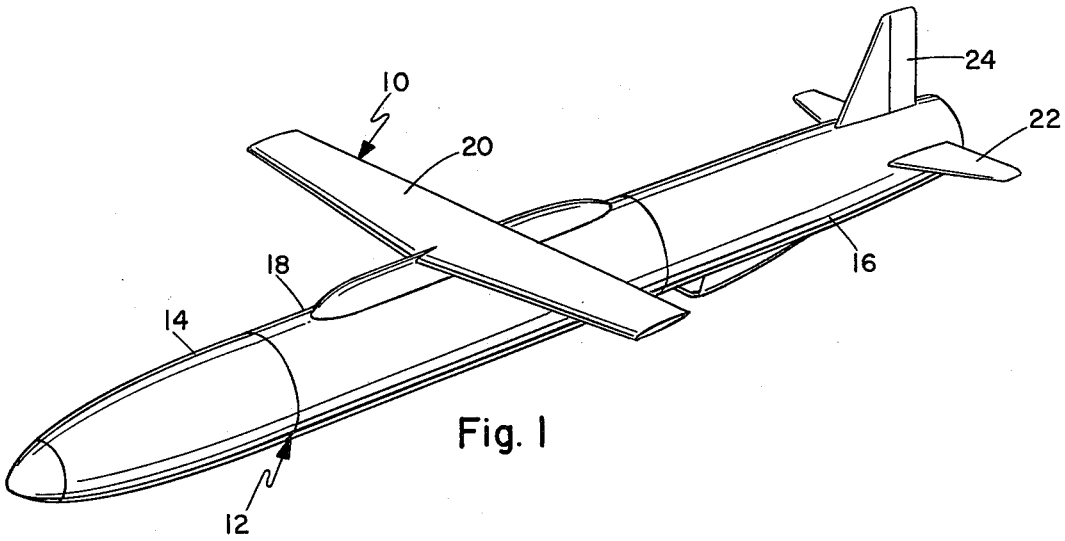
FIG. 1 is a perspective view of a typical vehicle incorporating the fuel tank/warhead structure.
Figure 2:
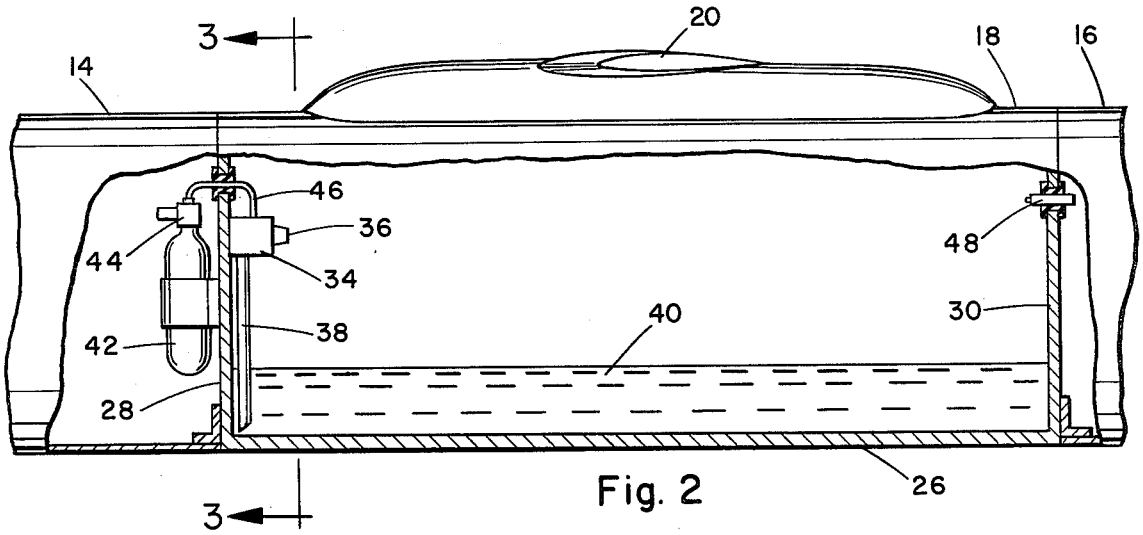
FIG. 2 is an enlarged side elevation view of the fuel tank structure, with portions cut away.

The vehicle illustrated in FIG. 1 is a typical remotely piloted aircraft type of missile and is only one example of the types of vehicles to which the fuel tank/warhead is adaptable. The structure can also be applied to a ballistic missile, a fin stabilized and steered missile, a powered glide bomb, or the like.

As illustrated, the vehicle 10 has a body 12 comprising a forward guidance section 14 and a rear propulsion section 16, between which is the fuel tank/warhead section 18. The vehicle has a supporting wing 20 and tail surfaces 22 and 24, with suitable control means for the particular flight requirements. Various control system and configurations are well known.

The guidance section may contain radio control means for remote control of the vehicle, or pre-programmed means for guiding the vehicle over a specific flight path. Activation of the warhead at the target may be by remote control, proximity detection, target identification sensor, or other such means, many different systems and techniques being well known.

Figure 3:
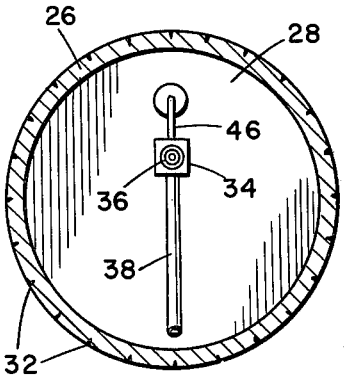
FIG. 3 is a sectional view taken on line 3—3 of FIG. 2.

The fuel tank/warhead section 18 comprises a casing 26 with end walls 28 and 30. As illustrated the casing itself is a portion of the vehicle body, which minimizes structure and simplifies the design. Internal bulkheads and stiffening structure, not shown, may be used according to the size and strength requirements of the vehicle. For fragmentation the casing 26 may have grooves 32, as in FIG. 3, to cause separation into suitably sized fragments, the technique being well known.

Mounted on end wall 28 is an atomizer 34, with a nozzle 36 directed into the fuel tank interior. The atomizer has a pick up tube 38 extending into the residual fuel 40. If the vehicle is of a type which may not remain in an upright position, a gravity operated flexible or rotatable pick up may be used. The atomizer is preferably of the well known ejector nozzle type driven by a stream of high velocity gas such as in a paint sprayer or the like. For this purpose a pressurized cylinder 42 of oxygen or other oxidizer is mounted on end wall 28, with a control valve 44 and a supply line 46 leading to the atomizer 34.

Mounted on end wall 30 is a detonator 48, which may be of spark, pyrotechnic, or other suitable type to ignite the explosive vapor.

As an example of the explosive effect available, a comparison will be made between a gasoline/oxygen mixture and dynamite. A typical 40% dynamite, such as Hercules Unigel, has an equivalent energy of about 438.5 Kcal per pound, or 454 grams.

Using a gasoline such as n-Octane ($C_8 H_{18}$), 37.9 grams of gasoline combined with 92.9 liters of oxygen will produce about the same amount of energy. The gasoline is assumed to be evenly distributed in fine droplets in the oxygen at 1 atmosphere pressure. Variations in detonation rate and pressure, energy release rate, casing bursting pressure and other factors will influence the actual explosive effect, but the comparison is a good example. Fuel other than gasoline may be used, depending on the particular propulsion means.

Figure 4:
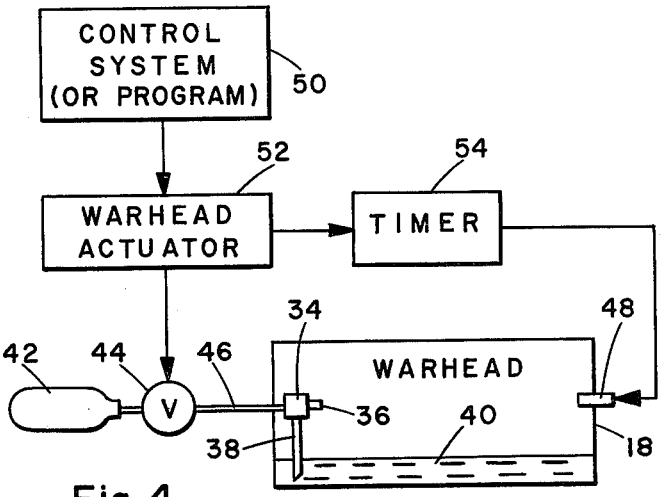
FIG. 4 is a diagram of the warhead actuating system.

In a typical mission the control system 50, in FIG. 4, controls the vehicle to the target, by remote control or program as mentioned above. At the target, a suitable signal triggers a warhead actuator 52, which may be a simple switch and power supply, such as a battery, or any other suitable initiating means. The warhead actuator 52 opens valve 44, releasing pressurized oxygen to the atomizer 34, which picks up and atomizes residual fuel mixed with the oxygen and sprays the mixture into the emptied portion of the tank.

The actuator 52 also starts a timer 54 which, after a predetermined short interval, actuates detonator 48 to explode the fuel/air mixture. The time delay will depend on the rate of atomization and other related factors. Any fuel remaining in liquid form will, of course, burn and add to the overall destructive capacity.

An effective weapon is thus provided without the complexity and cost of a separate warhead, using fuel which would have otherwise been wasted. While the structure has been shown and described for use in an airborne vehicle, it could obviously be applied to a surface travelling vehicle.

Having described my invention, I now claim:

1. In a vehicle having combustible fuel powered propulsion means, the improvement comprising:

a fuel tank for containing the combustible fuel used for propulsion;

a fluid pressure actuated atomizer mounted in said fuel tank and having a nozzle directed into the tank;

a source of pressurized oxidizer connected to and driving said atomizer;

detonating means mounted in said fuel tank for detonating the atomized fuel and oxidizer mixture, whereby the fuel tank is an explosive warhead;

and timing means for actuating said detonating means at a predetermined time after operation of said atomizer.

2. The structure of claim 1, wherein said fuel tank comprises a casing having end walls, said atomizer being mounted on one end wall and said detonating means being mounted on the other end wall.

* * * * *